United States Patent [19]

Brainard, II

[11] Patent Number: 4,597,351

[45] Date of Patent: Jul. 1, 1986

[54] ACCUMULATOR

[75] Inventor: Edward C. Brainard, II, Marion, Mass.

[73] Assignee: ENDECO-Environmental Devices Corp., Marion, Mass.

[21] Appl. No.: 507,946

[22] Filed: Jun. 24, 1983

Related U.S. Application Data

[63] Continuation of Ser. No. 293,676, Aug. 17, 1981, abandoned.

[51] Int. Cl.[4] ..... A63C 15/06

[52] U.S. Cl. ..... 114/230; 441/23

[58] Field of Search ..... 267/74, 73, 69; 114/230, 293; 441/21, 23

[56] References Cited

U.S. PATENT DOCUMENTS

| | | | |
|---|---|---|---|
| 345,660 | 7/1886 | Ashworth | 2/339 |
| 367,727 | 8/1887 | Potter | 267/73 |
| 563,001 | 6/1896 | Ziegler | 87/2 |
| 1,002,448 | 9/1911 | Putnam | 267/69 |
| 2,117,322 | 7/1937 | Hillman | 267/69 |
| 2,132,616 | 9/1937 | Hardie | 241/12 |
| 2,878,013 | 2/1957 | Piodi | 267/69 |
| 3,353,817 | 5/1965 | Bollinger | 267/69 |
| 3,370,841 | 10/1965 | Werner et al. | 267/73 |
| 3,817,507 | 6/1974 | Derman | 267/74 |
| 3,869,114 | 3/1975 | Schneider | 267/69 |
| 3,931,656 | 1/1976 | Thomson | 9/310 E |
| 4,044,415 | 8/1977 | Wood | 9/310 E |
| 4,258,608 | 3/1981 | Brown | 87/6 |

FOREIGN PATENT DOCUMENTS

| | | | |
|---|---|---|---|
| 116975 | 7/1918 | United Kingdom | 267/69 |

*Primary Examiner*—Trygve M. Blix
*Assistant Examiner*—C. T. Bartz
*Attorney, Agent, or Firm*—Kenway & Jenney

[57] ABSTRACT

An accumulator particularly adapted for mooring instruments in an ocean environment. The accumulator includes a solid rubber core surrounded by a nylon overbraid. The nylon overbraid is seized by means of high tensile strength tape to the rubber core at intervals along its length. The ends of the accumulator are terminated in loops surrounding steel thimbles. The loops are formed by standard braid splicing techniques. The accumulator is capable of elongation to three times its relaxed length and has an ultimate breaking strength in excess of 15,000 lbs.

10 Claims, 1 Drawing Figure

ACCUMULATOR

BACKGROUND OF THE INVENTION

This application is a continuation of Ser. No. 06/293,676, filed 8-17-81, now abandoned.

This invention relates to accumulators or shock cords, and more particularly to an accumulator which is capable of a 300% elongation and has a high breaking strength.

Many instrument and equipment mooring systems such as buoys for measuring various parameters of the ocean environment require a resilient elastic accumulator between the instrument buoy platform and the mooring so as to reduce wave surge loads. Because an accumulator is extensible, the rate at which stresses build up on the instrument and the mooring is limited so that damaging perturbations are substantially eliminated. In most such applications the working loads are confined to a range in the hundreds of pounds, but the ultimate breaking strength of an accumulator must be many thousands of pounds in order to survive severe storm conditions, for example. In addition, an accumulator must be able to cope with ocean current loads and the extreme tensions imposed on an accumulator during ship deployment and retrieval. In addition to a high breaking strength and the ability to stretch to several times its relaxed length, an accumulator must be relatively immune from surface abrasion and slippage of the terminations by which the accumulator is attached to the buoy and the mooring.

Known shock cord systems, using longitudinal rubber filaments with a synthetic covering or overbraid, typically have only a 100% working elongation which is inadequate for managing stress buildup in typical field applications. Single element extruded cords of synthetic rubber can provide elongations of up to 700%, but their tensile strength of 2500 lbs. per sq. in. is not sufficient to handle the maximum loads encountered in an ocean environment. In addition, such a rubber cord is difficult to terminate and is subject to surface abrasion which can reduce the maximum breaking strength even further. Often the termination on a single element extruded cord slips and gives way before the maximum working load of the material is reached.

It is therefore an object of this invention to provide an accumulator which is cabable of elongation of approximately 300%.

A further object of this invention is an accumulator which has a very high ultimate breaking strength.

Yet another object of this invention is an accumulator which is relatively immune from surface abrasion.

A still further object of this invention is an accumulator which substantially eliminates termination slippage.

Yet another object of the invention is an accumulator having the above-mentioned characteristics and which is simple and inexpensive to manufacture.

Other objects, features and advantages of the invention disclosed herein will be particularly pointed out in what follows.

SUMMARY OF THE INVENTION

The foregoing objects are accomplished by an accumulator including an extensible resilient core element having a relaxed state and a stretched state. A braided covering of strands of relatively inextensible material loosely surrounds the core element in its relaxed state and comes into tension only when the core element is in its stretched state. The braided covering is seized to the core element at intervals along the length of the core element to prevent the covering from slipping down the core element.

In a preferred embodiment of the invention disclosed herein, the core element is solid synthetic rubber and the braided covering is made of nylon strands. The covering is seized to the core with a high tensile strength, glass reinforced tape. In the manufacture of the accumulator disclosed herein, it is preferred that the covering be seized to the core element when the core element is in its stretched state. In this embodiment the stretched state is approximately three times the length of the relaxed state.

BRIEF DESCRIPTION OF THE DRAWING

The invention disclosed herein will be better understood with reference to the following drawing of which.

DESCRIPTION OF THE PREFERRED EMBODIMENTS

Figure 1:
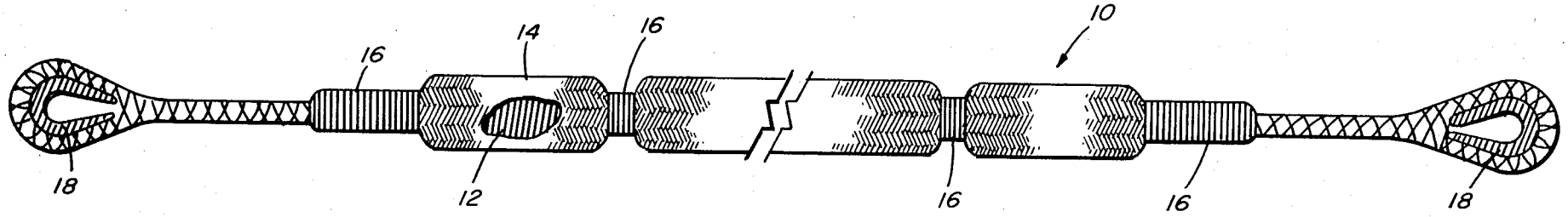
FIG. 1 is an elevation view, partially broken away, of the accumulator disclosed herein.

With reference to FIG. 1, the accumulator 10 includes a synthetic rubber core 12 having a circular cross-section and a diameter of 1 $\frac{3}{8}$ inch. A suitable rubber material is Duro-4S cord available from Delford Industries of Middletown, N.Y. Such material has a durometer of 45–55 and a tensile strength of 2500–2700 lbs. per sq. in. Such material can stretch approximately 700% before breaking. Although the preferred core material is a single, solid piece, multiple elastic strands can be used. The core 12 is surrounded loosely by an overbraid 14 made of nylon strands. Suitable strands are made from plied nylon yarns and have at least a 10,000 lb. breaking strength. Suitable nylon braid is available from New England Ropes, Inc., of New Bedford, Mass. As shown in FIG. 1, the nylon overbraid 14 is seized to the core 12 at intervals by means of tape 16. It is preferred that the tape 16 be a glass reinforced tape having high tensile strength. A suitable tape is available from Permacel of New Brunswick, N.J., under the designation P-162 Strap-it ®.

The preferred method of manufacturing the accumulator 10 will now be described. A length of the rubber core material 12 is selected according to the desired relaxed or working length of the finished accumulator. This length of rubber core material 12 is then stretched to approximately three times its relaxed length. A length of the overbraid material 14, corresponding in length to this stretched length of the rubber core 12, is then slid over the rubber core 12. To facilitate this sliding operation, it may be desirable to coat the core material 12 with talcum powder. While the core material 12 remains stretched, the overbraid 14 is seized to the rubber core 12 by means of the glass reinforced tape 16. Although the separation between places where the seizing takes place is not critical, it is preferred that the separation be approximately 5 feet when the accumulator is in its relaxed state. Thus, after the overbraid 14 has been seized to the rubber core 12 by means of the tape 16, when the accumulator 10 is allowed to resume its relaxed state, the overbraid 14 will tend to bunch up and loosely surround the rubber core 12. The diameter of the accumulator 10 in its relaxed state is thus about 2.25 inches, substantially greater than the 1 $\frac{3}{8}$ inch diameter of the core. This degree of looseness of the overbraid provides hydrodynamic damping which is desirable for mooring sensitive instruments in an ocean wave environment. The final operation is terminating the ends in loops. As can be seen in the figure, the loops include galvanized steel thimbles 18 surrounded by the core material 12 and overbraid 14. The loop around the thimbles 18 is made by the conventionally known technique of splicing an overbraided material which is often known as the "Chinese Finger Puzzle" principle. In such a case, the more tension that is placed on the accumulator, the tighter the nylon braid grabs to make a secure termination.

During operation, as the accumulator 10 begins to stretch, all of the load is carried by the rubber core 12, because the nylon overbraid 14 is very loosely surrounding the core 12. When, however, the accumulator 10 is stretched to approximately three times its relaxed length, the strands of the nylon overbraid 14 go into tension and carry the full load. As discussed above, since the core element itself can stretch about 700%, stretching 300% will not break the rubber core. In this way maximum loads of 15,000–17,000 lbs. can be maintained before the accumulator 10 breaks. Because the accumulator 10 can stretch to approximately three times its relaxed length, loads encountered at sea are reduced so that sensitive instruments are not damaged in a rough sea environment. In addition, the accumulator 10 has a high ultimate breaking strength to avoid breakage and instrument loss even in severe storm conditions.

It is to be noted that the accumulator 10 can be made in a variety of lengths and diameters. The accumulator 10 shown in FIG. 1 has a preferred active or relaxed length of about 46 feet, and the rubber core 12 has a diameter of about 1 $\frac{3}{8}$ in. For this embodiment, about 400 lbs. are required to stretch the accumulator to three times its relaxed length. An accumulator might also have a rubber core with a 1 in. diameter, in which case about 200 lbs. are required to stretch it to three times its relaxed length.

It is thus seen that the objects of this invention have been achieved in that there has been disclosed an accumulator which is capable of a 300% elongation and which has an approximately 15,000 lb. breaking strength. The accumulator is resistant to abrasions since the inner elastic core is surrounded by a tough nylon braid having a high tensile strength. The accumulator disclosed herein is easy and inexpensive to manufacture and has terminations which are resistant to slippage.

It is recognized that variations and modifications will occur to those skilled in the art, and it is intended that all such modifications and variations be included within the scope of the appended claims.

What is claimed is:

1. Accumulator comprising:

an extensible, resilient core element having a relaxed state and a stretched state;

a braided covering comprising strands of relatively inextensible material having a high tensile strength loosely surrounding said core element in its relaxed state and coming into tension only when said core element is in its stretched state; and means for seizing said covering to said core element at a plurality of intervals intermediate the seizing at the ends along the length of said core element, whereby said braided covering will carry the full load applied to said accumulator when it is in its stretched state.

2. The accumulator of claim 1 wherein said core element is a rubber material.

3. The accumulator of claim 1 wherein said strands of said relatively inextensible material are nylon.

4. The accumulator of claim 1 wherein said seizing means comprises high tensile strength tape.

5. The accumulator of claim 1 wherein said covering is seized to said core element when it is in its stretched state.

6. The accumulator of claim 1 wherein said stretched state is approximately three times as long as said relaxed state.

7. The accumulator of claim 2 wherein said rubber material is one solid piece.

8. The accumulator of claim 2 wherein said rubber material comprises a plurality of strands.

9. The accumulator of claim 4 wherein said tape is glass reinforced.

10. Accumulator comprising:

an extensible and resilient solid rubber core element having a relaxed state and a stretched state;

a braided covering comprising strands of high tensile strength nylon loosely surrounding said rubber core element in its relaxed state and coming into tension only when said rubber core element is in its stretched state; and high tensile strength, glass reinforced tape adapted for seizing said covering to said rubber element at a plurality of intervals intermediate the seizing at the ends along the length of said rubber element, whereby said braided covering will carry the full load applied to said accumulator when it is in its stretched state.

* * * * *